United States Patent [19]

McCoy

[11] 4,452,161

[45] Jun. 5, 1984

[54] HOOK FOR ATTACHING RIDER TO BOARD SAILER

[76] Inventor: Donald G. McCoy, 69 Penfold Rd., Rosslyn Park, Australia

[21] Appl. No.: 371,299

[22] PCT Filed: Aug. 11, 1981

[86] PCT No.: PCT/AU81/00109

§ 371 Date: Apr. 12, 1982

§ 102(e) Date: Apr. 12, 1982

[87] PCT Pub. No.: WO82/00448

PCT Pub. Date: Feb. 18, 1982

[30] Foreign Application Priority Data

Aug. 11, 1980 [AU] Australia ..... PE4975

[51] Int. Cl.[3] ..... B63B 9/08

[52] U.S. Cl. ..... 114/39; 114/97

[58] Field of Search ..... 114/39, 97–99, 114/253, 218; 440/34, 33; 441/74, 75, 106–119; 182/3–9, 231–235; 24/230.5, 231, 241 R, 242, 232 R, 233, 234, 235–237

[56] References Cited

U.S. PATENT DOCUMENTS 4,112,865 9/1978 Carn ..... 114/39

FOREIGN PATENT DOCUMENTS 2835579 2/1980 Fed. Rep. of Germany ..... 114/39
2837534 3/1980 Fed. Rep. of Germany ..... 114/39
2845081 4/1980 Fed. Rep. of Germany ..... 114/39

*Primary Examiner*—Trygve M. Blix
*Assistant Examiner*—Stephen P. Avila

[57] ABSTRACT

A quick release-hook to be secured to the chest harness of the rider of a board sailer. The hook helps in bracing the sail of the board sailer by engaging a loop of a rope attached to the boom-like rail of the board sailer. The hook (9) pivots from hooking to release position when the rider moves the rope through the hook so that thicker portions of the rope can press abutment members (21), forcing resilient tongue (17) out of engagement with the hook which then pivots, passing through slot (25) between members (21) to release the rope.

4 Claims, 3 Drawing Figures

HOOK FOR ATTACHING RIDER TO BOARD SAILER

Figure 1:
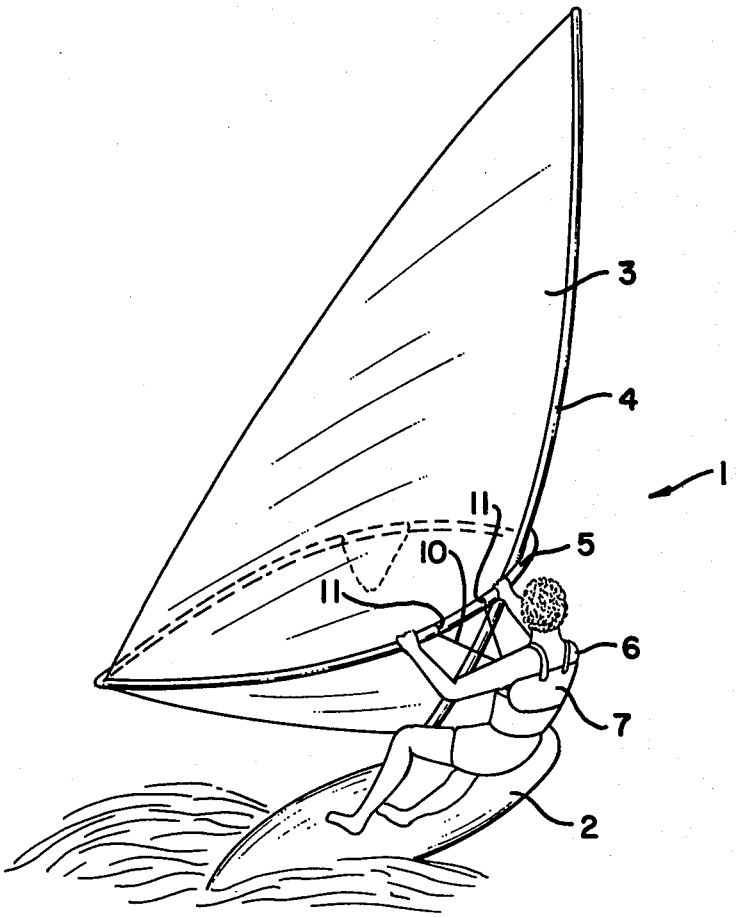

This invention relates to apparatus and a method of using the apparatus applicable to a sport now known as board sailing.

The concept of board sailing is now very well known involving a single sail with a hull on which the sail through a supporting mast is adjustably supported and the rider controls the craft by standing on the hull and holding the sail by means of a control rail which is secured to the mast and the sail and extends around these.

The problem to which this invention is related is a difficulty associated with holding the sail in a required position over a period of time.

It is common to have a rope attached with respect to the control rail and a hook secured by means of a harness to the rider so that when the rope is engaged in the hook, a significant amount of the tension can be transferred from the arms to the hook.

The difficulty is that in the event that the rider wishes to release the rope from engaging within the hook, he must first release the tension and thereby relocate the rope from around the tongue of the hook to effect the release.

In emergency situations, it has been discovered that it can be most difficult to provide this first release of tension to ensure disengagement and indeed in an emergency situation, it is very difficult for the rider to provide this necessary manoeuvre to provide such freeing of the interlocking position of the rope with respect to the hook.

While a number of these manoeuvres can be explained it will be appreciated that in the event of an unexpected gust of wind hitting the sail, this may force the sail over unbalancing and pulling the rider over who then can be pulled down into the sail, thus effectively losing his balance and generally unable to provide further release of tension until with balance gone he falls into the sail.

This of course can be a difficult if not dangerous situation and illustrates a typical problem to which this invention is directed.

A further problem relates to a difficulty that when a rider is engaged in a racing competition, there is some difficulty in having to disengage the rope from the block very quickly, and it is conventional that prior to intending to go about, the hook must be disengaged thereby anticipating such a manoeuvre.

In a manoeuvre such as "cover tacking" this can be effective warning to the competitor that the rider does intend to go about and significant competitive advantage can be thereby lost.

The invention in one form can then be said to reside in an arrangement providing for support assistance of a board sailer sail by a rider where this includes a hook secured to the rider, and a rope having ends secured in spaced apart relationship to a control rail providing a loop engaging with the hook, the arrangement being characterised in that a hook member of the hook can be released to a non-hooking position to release the loop by effecting a selected relative movement of the hook with respect to the rope loop.

It has been discovered that where as it is very difficult in any emergency situation to release the tension necessary to have the rope lifted away while under this tension from engagement with the hook, it is extremely common in any difficult situation for there to be relative movement of the rope with respect to the hook for instance sliding the rope through the hook and according to this invention there is therefore proposed means which effect release of the hooking relationship of the rope with the hook upon this occurring.

The invention can reside in a hook so adapted to effect a release when such relative motion occurs or it can reside in the combination of a rope shaped so as to effect a triggering of a hook with a hook so adapted to effect this release with such circumstances occurring.

While this broader concept can be achieved in many differing ways, there are particular advantages in providing for a specific arrangement.

The invention then could be said to reside in a hook adapted to be secured to the body of a board sailer rider and including a base, and a hook member secured to the base in such a way that the hook member can be retained with the base, in either a hooking position or a non-hooking position, and holding means with the hook adapted to hold the hook member in a hooking position the hook being characterised in that the holding means are adapted to effect release of the hook member from a hooking position upon inclusion through the hook of a member of greater than a selected width.

With such an arrangement, the rope can either be made to have thicker portions and thinner portions so that in a normal hooking position the thinner portion engages the hook whereas with release, the thicker portion is pulled in to the hooking location so as to trigger the release of the hook member.

The setting of the position of the thicker as compared to thinner portions of a rope can be well within any rider's discretion.

The invention can further reside in a specific form of the hook so that this can reside in a hook adapted to be secured to the rider of a board sailer at or about his chest and including a base to be held by straps against the chest of this rider and a hook member pivotally supported by the base member, and holding means constituted by a release lip arranged to interlock with a portion of the hook member to hold this in a hooking position, but to be divertable against resilient pressure to allow the hooking member to be released from the hooking position, and resilient means to urge the hooking member back into a hooking position after being released therefrom.

If then, one locates a release member in adjacent relationship to the hook then in the event of an accident occurring such as a high wind gust, the rider even though tension still exists between the rope and the hook, without losing balance, shift quickly to one side or another effectively pulling the hook in that direction and having this engage the release member on the rope which in turn then quickly releases the hook from a hooking condition which in turn releases the rope.

Perhaps it can be said that the concept of providing that the hook member is releasable from a hooking position by relative sideways movement with a held rope is a feature of this invention.

Obviously, it is preferred that the hook be secured to the rider so that the one hook can be used on either side of the sail and accordingly, the invention can reside in an arrangement in which there is a hook secured by harness to a rider and adapted to engage by hooking a rope the ends of which are secured to a control rail of a board sailer, the hook being adapted to be released from a hooking condition by reason of engagement of trigger means secured to each side of the hook but on or with the rope such that by location of the hook with respect to the rope in the vicinity of the release member, this will effect release of the hook from a hooking position.

There are obviously differing ways by which the hook can be made to work and of course different ways in which each release member can be adjustably secured and made to provide the release mechanism upon coincidence of the position of the releases member with the hook.

Preferably the trigger or release means are easily adjusted in position by the rider during use but at the ame time will hold firm in the event that they are engaging the release mechanism on the hook.

Figure 2:
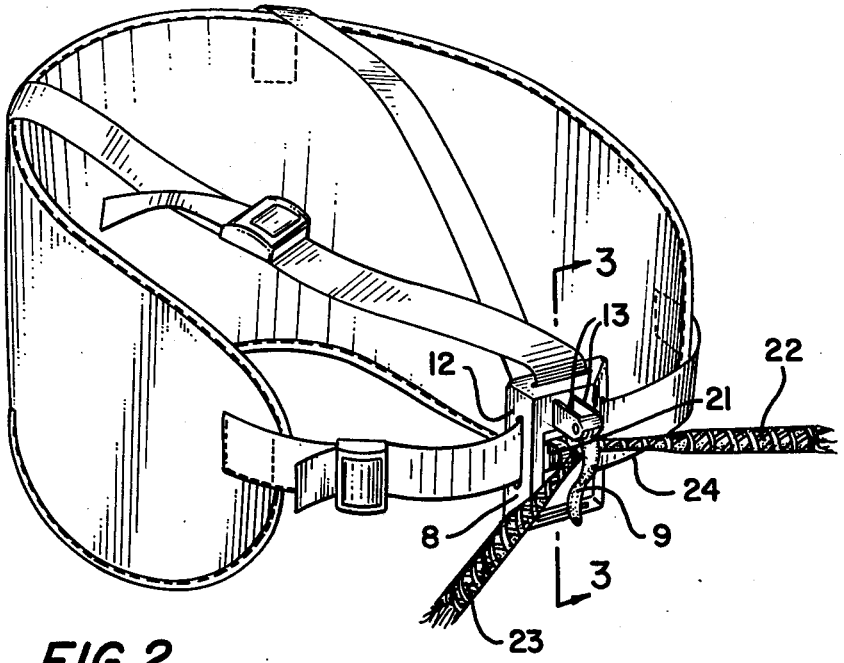
Figure 3:
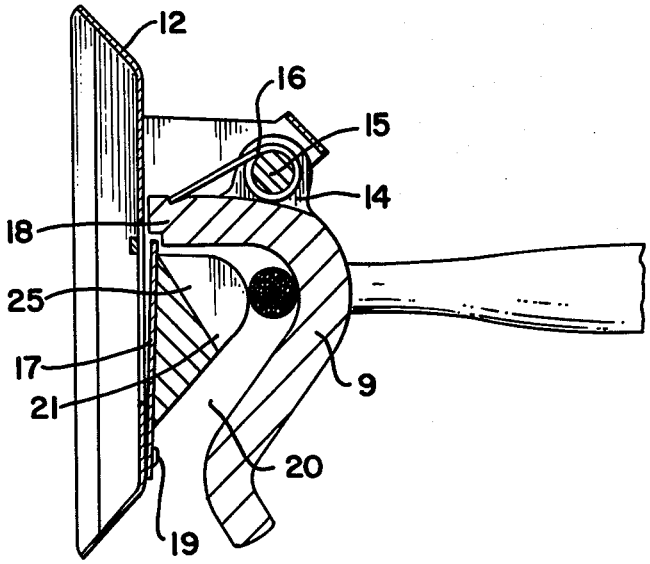

For a better understanding of the invention will now be described with the assistance of drawings in which FIG. 1 illustrates a perspective view of a two people board sailer with a rider using the rope assistance with respect to the hand holder surrounding the sail of the board sailer, FIG. 2 is a perspective view of the assembly according to this preferred embodiment according to this invention showing the Hawaiian Harness fitted however to a hook showing a rope modified according to this invention passing therethrough, and FIG. 3 is a cross section along the lines of 33 of FIG. 2 without however the straps so as to assist in clarification of the illustration.

Referring in detail to the drawings there is seen a board sailer 1 which has a board 2 and a sail 3, the sail having a forewardmost mast 4 and being surrounded by a hand holder 5.

The rider 6 has secured around his chest and over his shoulders the Hawaiian Harness 7 to which against his chest is located a hook 8.

Adapted to pass through the hook shape and be engaged by the hook member 9 of the hook 8 is a rope 10 which is secured at its ends 11 at spaced apart locations on the hand holder 5.

The hook 8 which is adapted to be held against the chest of the rider 6 includes a base 12 and outwardly extending tongues 13 between which is pivotally supported the hooking member 9 constituted by a leg of tortuous hook shape which has secured to an upper end thereof cheeks 14 through which passes pin 15 around which helical spring 16 engages to provide resilient positioning of the hook member.

The position of the hook member 9 is governed by support by the pivotal support provided by pin 15.

It is also further governed by interlocking relationship of the resilient tongue 17 which in a normal position as is shown in FIG. 3 interlocks with end 18 of the hook member 9.

The resilient tongue 17 is secured at its lower end by means of rivet connection 19 to the base 12.

Secured so as to protrude into the otherwise open hooking space 20 are abutment members 21.

The rope adapted to engage through the hook 8 by reason of its engagements with the concave portion of hooking member 9 is differently shaped so as to be thicker in parts as shown at 22 and 23 as compared to other portions at 24.

Accordingly the distance between the inner side of the concave shape of hooking member 9 and the outer periphery of member 21 is such that with the smaller diameter portion of the rope therebetween this will leave the resilient member 17 which acts as a trigger member in the interlocking position so as to ensure maintenance of the hooking position of the hooking member 9 as shown in FIG. 3.

However with the inclusion between the respective members 9 and 21 of the wider portion of the rope either 22 or 23, this will cause the resilient member 17 to push away from the interlocking position with respect to the end 18 of the hooking member 9 which allows this to pivot about the pivot pin 15 and effect a non-hooking position or at least a non retaining position with respect to a rope under tension acting through the hook shape.

There is a slot 25 adapted to allow the end 18 through without interference to pass the member 21.

The spring 16 will automatically return the hooking member 9 to a hooking position by returning the end 18 to an interlocking position with respect to the resilient member 17 after release of the tension of any rope otherwise held within the hooking shape.

With the arrangement described, it will now be appreciated by that by using a hook according to this invention held by an appropriate harness, allows a rider to be able to automatically and quickly effect a release in certain situations of the hooking position with respect to the rider's body.

The hook mechanism in itself provides for a very economical and practical way of providing for this mechanism and overall the invention provides for a significant improvement in relation to the sport and apparatus for board sailing or like sports including using similar devices for sailing on land and even ice.

I claim:

1. A quick-release apparatus for attaching a rider to a board sailer comprising:

a base member;

a support member extending outwardly from said base member;

a hooking member pivotally supported on said support member for rotation in a plane perpendicular to said base member;

said hooking member comprising a latching end portion extending toward said base member and a curved hook portion extending away from and curved back toward said base member;

a trigger member comprising a tongue fixed to said base member beneath said hooking member and having one end resiliantly biased outwardly to engage said latching end portion;

an abutment member mounted on said trigger member tongue and extending into said hook portion of said hooking member to form a spaced area therebetween; and a flexible rope means having a center portion of a diameter smaller than said spaced area and end portions of a diameter larger than said spaced area, said center portion being adapted to engage said hook portion of said hooking member and be laterally slidable between said hooking member and said abutment member, whereby lateral movement of said rope means within said spaced area to a postion where said larger diameter end portion comes between said hook portion and said abutment member will cause said trigger member to be urged toward said base member, thereby disengaging said trigger member from said latching portion and permitting said hook portion of said hooking member to pivot away from said base member and disengage said rope means.

2. A quick-release apparatus as claimed in claim 1 further comprising spring means arranged to resiliently urge said hooking member into a hooking position.

3. A quick-release apparatus as claimed in claim 2 further comprising a harness adapted to be worn by said rider, said base member being fixed to said harness.

4. A quick-release apparatus as claimed in claim 3 wherein said rope means is adapted to be fastened at its ends to said board sailer.

* * * * *